United States Patent [19]

Lietzke et al.

[11] 4,400,111

[45] Aug. 23, 1983

[54] ARRANGEMENT FOR RAISING AND LOWERING A FLOATING OFFSHORE PLATFORM

[75] Inventors: Heinz Lietzke, Neuss; Heribert K. Mayr, Mülheim, both of Fed. Rep. of Germany

[73] Assignees: Deutsche Babcock Aktiengesellschaft, Oberhausen; Schiess-Defries Hebezeug-und Transporteinrichtungen GmbH, Düsseldorf, both of Fed. Rep. of Germany

[21] Appl. No.: 239,117

[22] Filed: Feb. 27, 1981

[51] Int. Cl.[3] ..... E02B 17/08

[52] U.S. Cl. ..... 405/196; 254/107; 405/195; 405/203

[58] Field of Search ..... 405/196–199; 114/264, 265; 254/106, 107, 105

[56] References Cited

U.S. PATENT DOCUMENTS

| | | | |
|---|---|---|---|
| 2,966,336 | 12/1960 | Owen | 405/197 X |
| 3,411,750 | 11/1968 | Smulders | 405/198 X |
| 3,474,749 | 10/1969 | Williamson | 405/196 X |
| 3,495,806 | 2/1970 | Sutton | 405/198 X |
| 3,628,336 | 12/1971 | Moore | 405/196 |
| 4,227,831 | 10/1980 | Evans | 405/196 |

*Primary Examiner*—Dennis L. Taylor
*Attorney, Agent, or Firm*—Max Fogiel

[57] ABSTRACT

An arrangement for raising and lowering a floating offshore platform having legs which are movable relatively to the platform. The legs, in the operating condition, are supported on the bottom of the sea, and a jacking device is blocked against downward movement whenever the floating platform is at a highest point of sea wave motion in a touched-down position of the legs. The jacking device may be in the form of rope winches, with the drive of one jacking device being switched off and the rope winch of the other jacking device being released in take-up direction, while being blockable in payout direction in touched-down position of the legs.

9 Claims, 5 Drawing Figures

ARRANGEMENT FOR RAISING AND LOWERING A FLOATING OFFSHORE PLATFORM

BACKGROUND OF THE INVENTION

The present invention relates to an arrangement for raising and lowering a floating offshore platform which is provided with legs movable relatively to it and supported, in the operating condition, on the bottom of the sea or on a substructure lowered to the bottom of the sea.

In order to establish the working position of such offshore platforms forming artificial islands, the legs are lowered to the bottom of the sea and the platform is then raised out of the water on the firmly seated legs until the necessary height above sea level has been reached. Lowering the legs onto the substructure is always a critical operation which, unless special measures are taken, can only be carried out under favorable weather conditions. Under favorable sea conditions the platform oscillating up and down with the waves may several times impinge upon the substructure with the extending legs before it is finally fixed. This may cause considerable damage.

The present invention pursues the object of improving equipment of the prior art, so that also under favorable sea conditions, the legs may touch down without shocks or substantially without shocks.

Another object of the present invention is to provide an arrangement of the foregoing character, which is simple in design and construction and which may be economically fabricated.

A further object of the present invention is to provide an arrangement, as described, which is provided with safety devices and which may be readily maintained in service.

SUMMARY OF THE INVENTION

According to the present invention, the objects are achieved by the jacking equipment being blocked against downward movement whenever the floating platform is at the highest point of the wave motion in the touched-down position of the legs. Preferably, the suggestion is made that two jacking means designed as rope winches should be arranged and that, with touched-down legs and floating platform, the drive of the one jacking means should be switched off. The rope winch of the other jacking means should be released in the take-up direction and should be lockable in the payout direction.

When the legs of an offshore platform provided with this inventive equipment have touched down, only the platform will be raised with a rising wave, while the legs will not change their position. When the platform floating upwardly has just reached the highest point of the wave motion, it will engage in this position and will not lower again with the descending wave. Should a further wave with a higher crest follow, the platform will be raised once more and will be hung up again at the highest point of the wave motion. In this manner, the platform is prevented from lowering with the descending wave. As a result, the platform can no longer oscillate up and down with the waves and cannot cause damage to the legs or the substructure.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

The floating platform 1 has a rectangular or square cross section; it is provided with four legs which are movable relatively to it and which may be raised as well as lowered. This platform 1 is towed to its sea location with raised legs 2. After the planned location has been reached, the legs are lowered by means of the jacking equipment described below; lowering is continued until the legs are seated on the bottom of the sea or on a substructure lowered to the bottom of the sea. Thereupon the platform 1 is raised to the desired height above sea level. In the operating condition, the legs 2 are supported on the bottom of the sea directly or indirectly.

Figure 1:
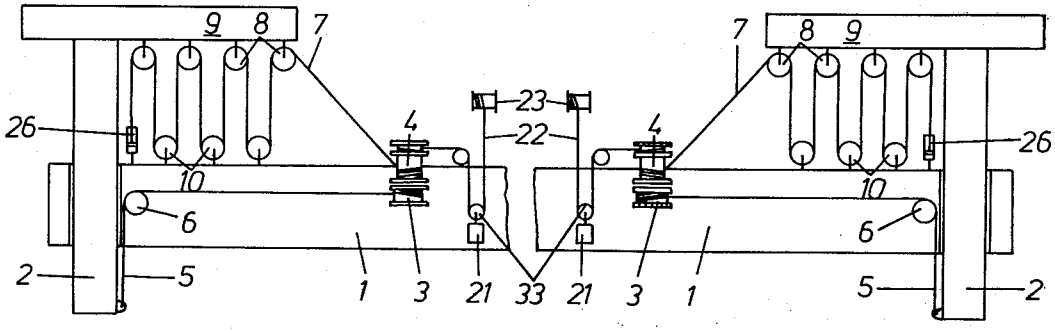
FIG. 1 shows schematically the side view of an offshore platform with jacking equipment, according to the present invention.
Figure 2:
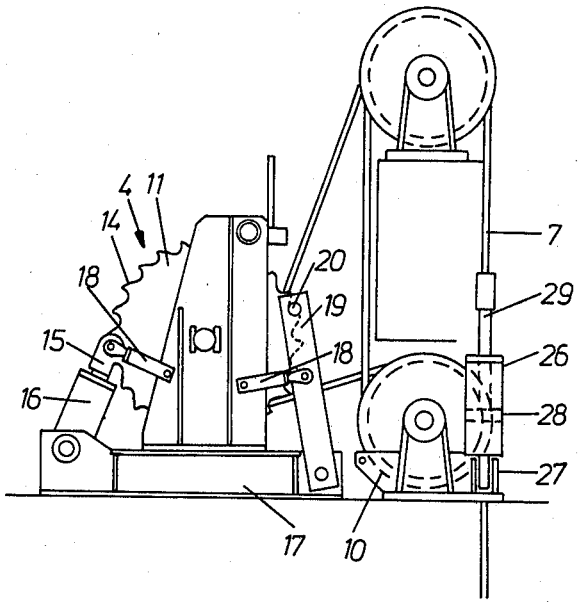
FIG. 2 is a side view of a jacking equipment.
Figure 3:
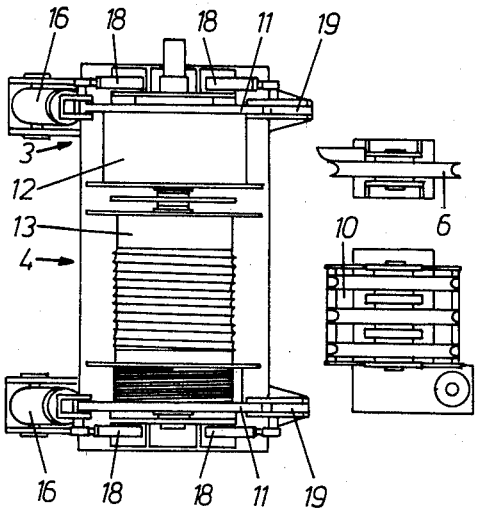
FIG. 3 is a view of the equipment shown in FIG. 2.

The jacking equipment consists of two unilaterally acting jacking units in the form of rope winches 3 and 4. These may be driven independently of each other. The two rope winches 3 and 4 are arranged on a joint base frame 17 located on platform 1. For better understanding, the two rope winches 3 and 4 are staggered by 90° in FIG. 1. Each of the four legs 2 is provided at least with one equipment of this kind.

The first rope winch 3 serves for lowering and raising the leg 2; preferably it works on a single rope strand. Rope 5 runs to the attachment point at the foot of leg 2 by way of a deflecting sheave 6 arranged on platform 1.

The second rope winch 4 serves for raising and lowering the platform 1; it works on a multiple rope strand. For introducing the load into leg 2, the jacking rope 7 runs by way of an upper sheave assembly 8 which is arranged on a yoke 9 of leg 2. The lower sheave assembly 10 with the rope attachment point is located directly before rope winch 4 on platform 1.

The drive of the rope winches 3 and 4 is accomplished each time by way of an entrainment ratchet wheel 11 which is connected with the rope drum 12 or 13, respectively. The head of piston rod 15 engages with the ratchets of the entrainment ratchet wheel 11. The piston rod 15 moves in a hydraulic cylinder 16 and is connected with a piston which is loaded on either side. The hydraulic cylinder 16 is pivoted to the base frame 17 carrying the rope winches 3 and 4. A cylinder arrangement 18 likewise pivoted on the base frame 17 pulls the head of the piston rod 15 into the position of engagement or pushes it into the idle position, respectively. In order to prevent the undesired reverse movement of the entrainment ratchet wheel 11 in the disengaged position of the piston rod 15, there is a ratchet locking means which consists of a swivelling pawl 19 and a pawl pin 20. The swivelling pawl 19 is pivoted on the base frame 17 and is caused to occupy the engaged position, like piston rod 15, by cylinder arrangement 18.

Figure 4:
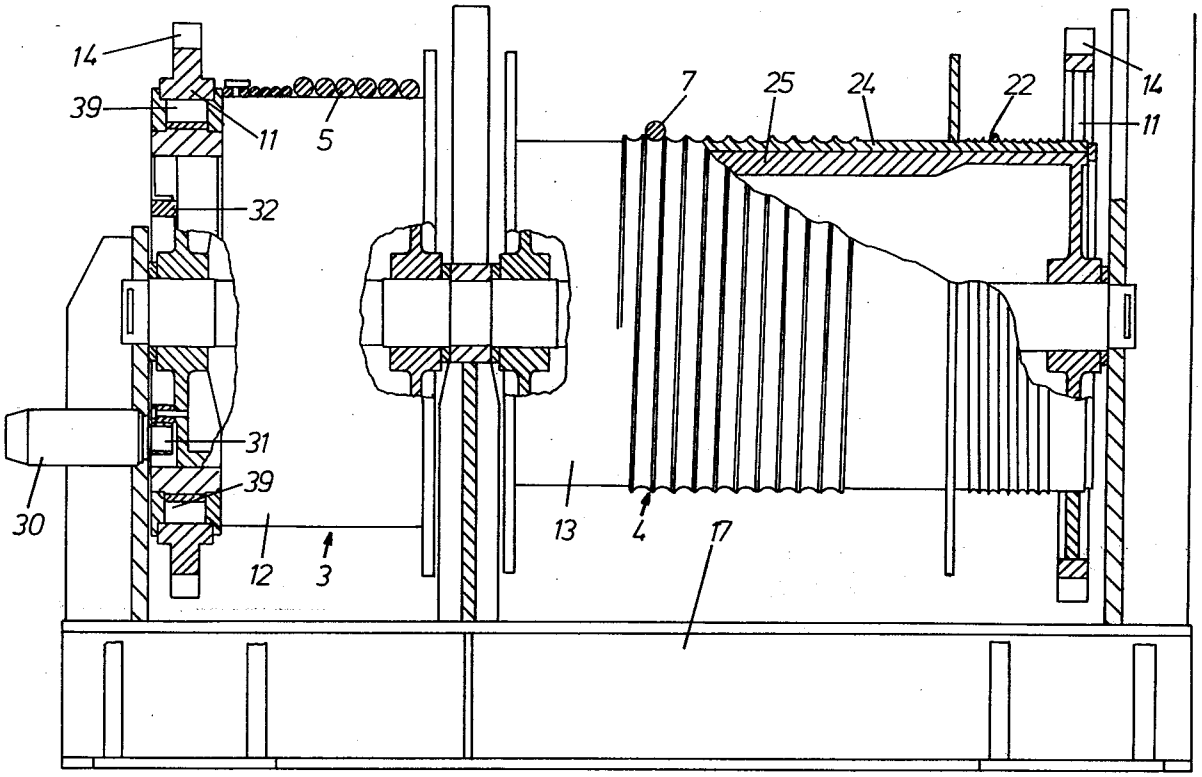
FIG. 4 is a longitudinal section through the rope drum of a jacking means.

As shown in FIG. 4, the first rope winch 3 is provided with a permanent rope tensioning means consisting of a low-rebound freewheel and a driving motor 30. The freewheel in the present case is designed as a clamping-body freewheel having clamping bodies 39 which are arranged between the entrainment ratchet wheel 11 and the rope drum 12. The driving motor 30 is flanged to the base frame 17 and drives a pinion 31 which is in engagement with a girth gear 32 attached to the rope drum 12. The driving motor 30 exerts a torque onto the rope drum 12 in the take-up direction of rope 5.

The second rope winch 4 is likewise provided with a slack-rope preventor. This preventor consists of rope 22 which is loaded by weight 21 and which is wound around the rope drum 13 of the second rope winch 4 against the take-up direction of the jacking rope 7. The weight 21 is connected with a loose sheave 33. The rope 22 wound around the rope drum 13 runs via sheave 33 to a compensating winch 23 installed on platform 1. A torque is produced on rope drum 13 by weight 21 in combination with compensating winch 23; in this way the jacking rope 7 is wound up or is paid out under initial stress. The compensating winch 23 ensures that the weight 21 is always kept at the same level. When the compensating winch 23 is blocked, the weight 21 produces the torque alone and changes its level.

The rope drum 13 of the second rope winch 4 consists of a hollow cylinder 24 which is slidingly carried on a statically stressed base drum 25. When the piston rod 15 and the locking pawl 19 are disengaged, the hollow cylinder 24 is dynamically stressed at low load. During the jacking operation, the hollow cylinder 24 forms one unit with the base drum 25. The inertia moment of the masses subjected to acceleration during freewheeling of the rope drum 13 is kept small by dividing the rope drum 13 into a low-mass hollow cylinder 24 and a base drum 25.

Figure 5:
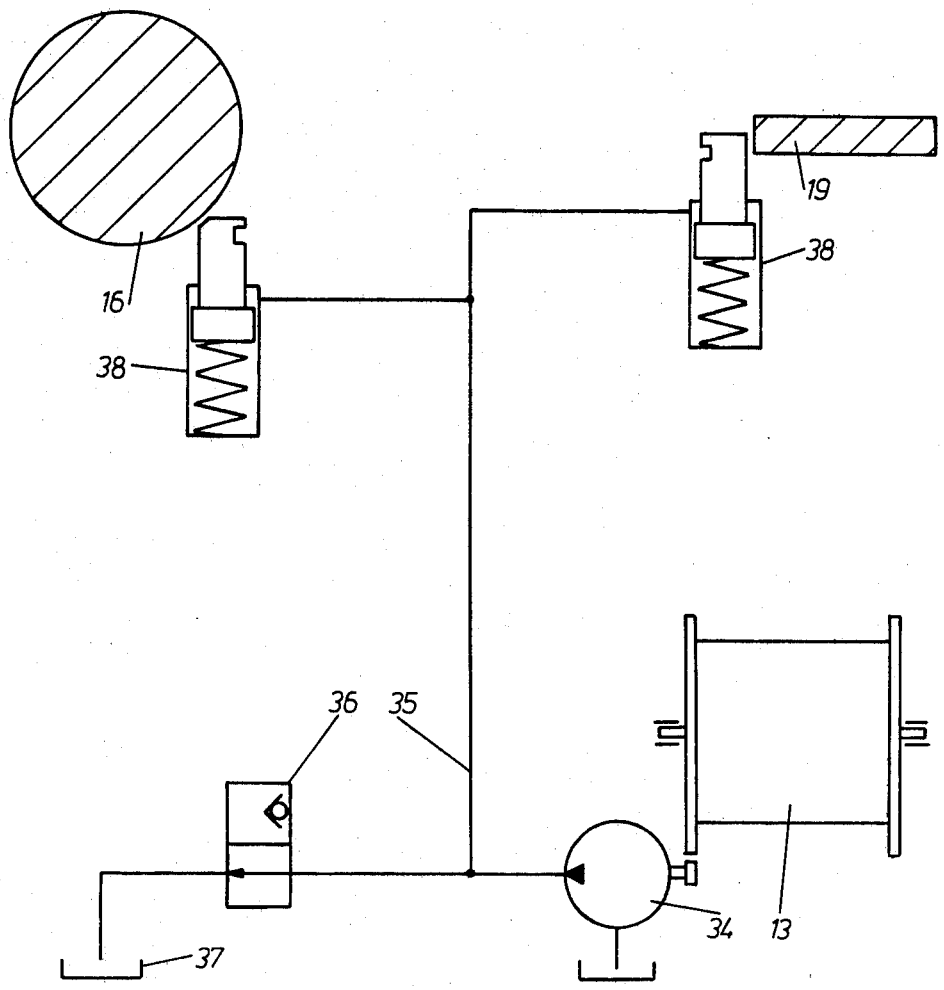
FIG. 5 is a flow diagram of a ratchet locking unit.

The ratchet locking means consisting of the locking pawl 19 and the pawl pin 20 as well as the hydraulic cylinders of the drive for the rope drum 13 of the second rope winch, are provided with hydraulic safety ratchet locking means, the flow diagram of which, is represented in FIG. 5. This ensures that the piston rod 15 and the locking pawl 19 are always in disengagement when platform 1 is moving downwardly.

The locking means consists of a pump 34, which is driven from the rope drum 13 of the second rope winch 4, and of the locking cylinders 38. Pump 34 delivers a pressure fluid through a hydraulic line 35 to the upper piston chambers of the locking cylinders 38 only when the rope drum 13 rotates in a sense which corresponds to the downward motion of the platform 1. Piston rod 15 and the locking pawl 19 are released for engagement upon the admission of pressure to these piston chambers. For safety reasons, the hydraulic line 35 is provided, moreover, with a valve 36 which must be activated prior to disengagement.

In order to achieve a uniform load absorption of the jacking equipment attacking the four legs 2, the rope attachment points of the jacking rope 7 are equipped with communicated balancing cylinders 26. These balancing cylinders 26 may be revolved about a horizontal axis and are maintained in position within a bearing fork 27 which is connected with platform 1. A piston 28 with piston rod 29 is guided within the balancing cylinders 26. The jacking rope 7 is attached to piston rod 29.

The equipment according to the present invention operates in the following manner; when platform 1 has reached the planned location at sea, the operation of lowering the legs 2 is initiated from a central control post. The drive of the first rope winch 3 is in engagement, while the head of the piston rod 15 and the swivelling pawl 19 of the second rope winch 4 are disengaged. By means of the first rope winch 3 all four legs 2 are synchronoulsy lowered step by step.

While the legs 2 are being lowered, the floating platform 1 is subjected to oscillations under the motion of the sea. When, while platform 1 is in a wave trough, a leg 2 touches the bottom of the sea or a substructure placed onto the bottom of the sea, the hydraulic pressure in the hydraulic cylinder 16 of the first rope winch 3 becomes reduced. When all hydraulic cylinders have undergone pressure reduction, one further lowering step is conducted.

During the following pressure reduction, the piston rod 15 and the locking pawl 19 of the first rope winch 3 are disengaged through the cylinder arrangements 18 and the first rope winch 3 is thus changed over to idle motion. In this way the legs 2 have touched down. The idle-motion position of the first rope winch 3 has the feature that platform 1 is able to carry out all movements under the motion of the sea without any connection, apart from friction, existing between platform 1 and legs 2. The distance between the upper sheave assembly 8 and the lower sheave assembly 10 becomes shorter during the lowering operation. The jacking rope thus slackened is wound up by the aid of the weight 21 and the compensating winch 23.

When the legs 2 have touched down, the platform 1 moves in the motion of the sea; after blocking of the compensating winch 23, the jacking rope 7 is reeled on and off by the aid of weight 21 under initial stress. Independently of the actual position of platform 1 in the motion of the sea, the command "Engaging" is given via a control. This causes the piston rod 15 and the locking pawl 19 of the second rope winch 4 to be engaged automatically as soon as platform 1 is in the upward motion.

As a result, rope drum 13 of the second rope winch 4 is prevented from rotating, contrary to the jacking direction, already in the downward motion of platform 1. In this manner, platform 1 is hung up or suspended in the uppermost position under the motion of the sea and is thus connected with the legs 2. When platform 1 is raised to a further extent by a higher wave that follows, it is automatically hung up or suspended in the new uppermost position.

When piston rod 15 and swivelling pawl 19 are engaged after platform 1 has been hung up, the stepwise jacking operation of platform 1 starts automatically. All rope winches 4 operate synchronously and will horizontally raise the platform. Different jacking lengths of one rope winch 4, e.g., upon changing into another rope layer, are made up by the balancing cylinders 26 at the rope attachment point.

When after a residence time of approximately 8 to 10 years the platform is to be moved to another location, it will be lowered according to basically the same principle; the same operations will then proceed in the inverse direction.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. An arrangement for raising and lowering a floating offshore platform, comprising: a platform with legs which are movable relatively to said platform, said legs in the operating condition being supported on the bottom of the sea; and jacking means on said platform and blocked against downward movement whenever said floating platform is at a highest point of sea wave motion in a touched-down position of said legs; said jacking means comprising two rope winches, the drive of one rope winch being switched off and the other rope winch being released in take-up direction and being blockable in payout direction in touched-down position of said legs and floating platform.

2. An arrangement as defined in claim 1, including rope drums on said rope winches; mounting means for holding said drums; each of said drums being connected with an entrainment ratchet wheel with ratchet teeth; a hydraulic cylinder pivotably mounted on said mounting means; said hydraulic cylinder having a piston rod engaging said ratchet teeth; ratchet locking means on said mounting means and having a pivotable blocking member engaging said ratchet teeth.

3. An arrangement as defined in claim 2, wherein one rope winch has a rope connected to the lower end of one leg, permanent rope tensioning means on said rope winch and having a low-rebound freewheel arranged between one rope drum and an entrainment ratchet wheel, and driving motor means exerting a torque onto said rope drum in take-up direction.

4. An arrangement as defined in claim 3, wherein the other rope winch has a drive with safety ratchet locking means comprising locking cylinders loaded with pressure fluid by a pump driven from the other rope drum and producing pressure only on the upward movement of said platform.

5. An arrangement as defined in claim 1, wherein said jacking means has jacking ropes with terminal points attached to piston rods guided in balancing cylinders connected with said platform.

6. An arrangement as defined in claim 5, wherein one rope winch has a slack rope preventor with a weight loaded rope wound around the rope drum of said one rope winch against reeling direction of the jacking rope.

7. An arrangement as defined in claim 6, wherein said drum of said one rope winch comprises a hollow cylinder slidingly carried on a base drum.

8. An arrangement as defined in claim 6, including a sheave around which said loaded rope runs to a compensating winch, said sheave being connected to said weight.

9. An arrangement as defined in claim 1, including substructure means lowered to the bottom of the sea for supporting said legs.

* * * * *